US012326261B2

(12) United States Patent
Kozinski

(10) Patent No.: US 12,326,261 B2
(45) Date of Patent: Jun. 10, 2025

(54) APPLIANCE CONTROL PANEL ASSEMBLY

(71) Applicant: Haier US Appliance Solutions, Inc., Wilmington, DE (US)

(72) Inventor: Kyle Andrew Kozinski, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 890 days.

(21) Appl. No.: 17/406,163

(22) Filed: Aug. 19, 2021

(65) Prior Publication Data

US 2023/0057096 A1 Feb. 23, 2023

(51) Int. Cl.

| | |
|---|---|
| ***F24C 15/08*** | (2006.01) |
| ***F24C 3/12*** | (2006.01) |
| ***F24C 7/08*** | (2006.01) |

(52) U.S. Cl.

CPC ..... *F24C 15/08* (2013.01); *F24C 3/124* (2013.01); *F24C 7/082* (2013.01)

(58) Field of Classification Search

CPC ..... F24C 15/12; F24C 15/08; F24C 7/082; F24C 3/124

USPC ..... 126/39 B, 214 B, 273 R; 312/263, 265.5

See application file for complete search history.

(56) References Cited

U.S. PATENT DOCUMENTS

| | | | | |
|---|---|---|---|---|
| 2,762,594 A | | 9/1956 | Reeves | |
| 5,358,323 A | * | 10/1994 | Ripley | D06F 39/12 312/263 |
| 6,837,555 B2 | | 1/2005 | Byrne | |
| 9,138,053 B2 | | 9/2015 | Steffens | |

* cited by examiner

*Primary Examiner* — Vivek K Shirsat

(74) *Attorney, Agent, or Firm* — Dority & Manning, P.A.

(57) ABSTRACT

An appliance includes a cabinet with a door mounted to a front portion of the cabinet. The door is movable between an open position permitting access to a chamber within the cabinet and a closed position wherein the door encloses the chamber. The appliance also includes a first end plate mounted atop the cabinet by a first hook and slot coupling and a second end plate mounted atop the cabinet by a second hook and slot coupling.

20 Claims, 15 Drawing Sheets

APPLIANCE CONTROL PANEL ASSEMBLY

FIELD OF THE INVENTION

The present disclosure relates generally to domestic appliances, such as oven appliances, and methods of assembling such appliances.

BACKGROUND OF THE INVENTION

Oven appliances generally include a cabinet having a top portion. A top panel, also referred to as a maintop, may be positioned on or over the top portion of the cabinet. Oven appliances typically include heating elements, e.g., electric heating elements or gas burners, for heating pots, pans, and other containers with food items therein. The heating elements are positioned within the maintop proximate to, e.g., below, a cooking surface of the maintop. Some oven appliances include a backsplash adjoining the maintop with a control panel disposed on the backsplash.

Assembly of such oven appliances typically includes multiple steps including connection of several fasteners at various angles. The back splash or control panel is typically connected with several fasteners at different angles and in different locations on the oven appliance, including in the back of the oven appliance. As a result, the conventional assembly processes require multiple parts and several steps which may be challenging. Further, once the oven appliance is in use it may be adjacent to or surrounded by fixtures such as counters, cabinets, etc., and may be placed against a wall, e.g., with the back of the oven appliance against the wall. As such, if it becomes necessary to take the oven appliance apart in order to access internal components, such as for maintenance, disassembling the oven appliance also presents some challenges.

Accordingly, an oven appliance with features for increased ease of assembly, reduced part count, and/or increased ease of access for maintenance would be useful.

BRIEF DESCRIPTION OF THE INVENTION

Aspects and advantages of the invention will be set forth in part in the following description, or may be apparent from the description, or may be learned through practice of the invention.

In an exemplary aspect of the present disclosure, an oven appliance is provided. The oven appliance defines a lateral direction, a transverse direction, and a vertical direction. The lateral direction, the transverse direction, and the vertical direction are mutually perpendicular. The oven appliance includes a cabinet extending between a top portion and a bottom portion along the vertical direction, between a left side and a right side along the lateral direction, and between a front portion and a back portion along the transverse direction. A first end plate is mounted to the cabinet by a first hook and slot coupling at the top portion of the cabinet. The first end plate extends along the left side of the cabinet between the front portion of the cabinet and the back portion of the cabinet. A second end plate is mounted to the cabinet by a second hook and slot coupling at the top portion of the cabinet. The second end plate extends along the right side of the cabinet between the front portion of the cabinet and the back portion of the cabinet.

In another exemplary aspect of the present disclosure an appliance is provided. The appliance includes a cabinet with a door mounted to a front portion of the cabinet. The door is movable between an open position permitting access to a chamber within the cabinet and a closed position wherein the door encloses the chamber. The appliance also includes a first end plate mounted atop the cabinet by a first hook and slot coupling and a second end plate mounted atop the cabinet by a second hook and slot coupling.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
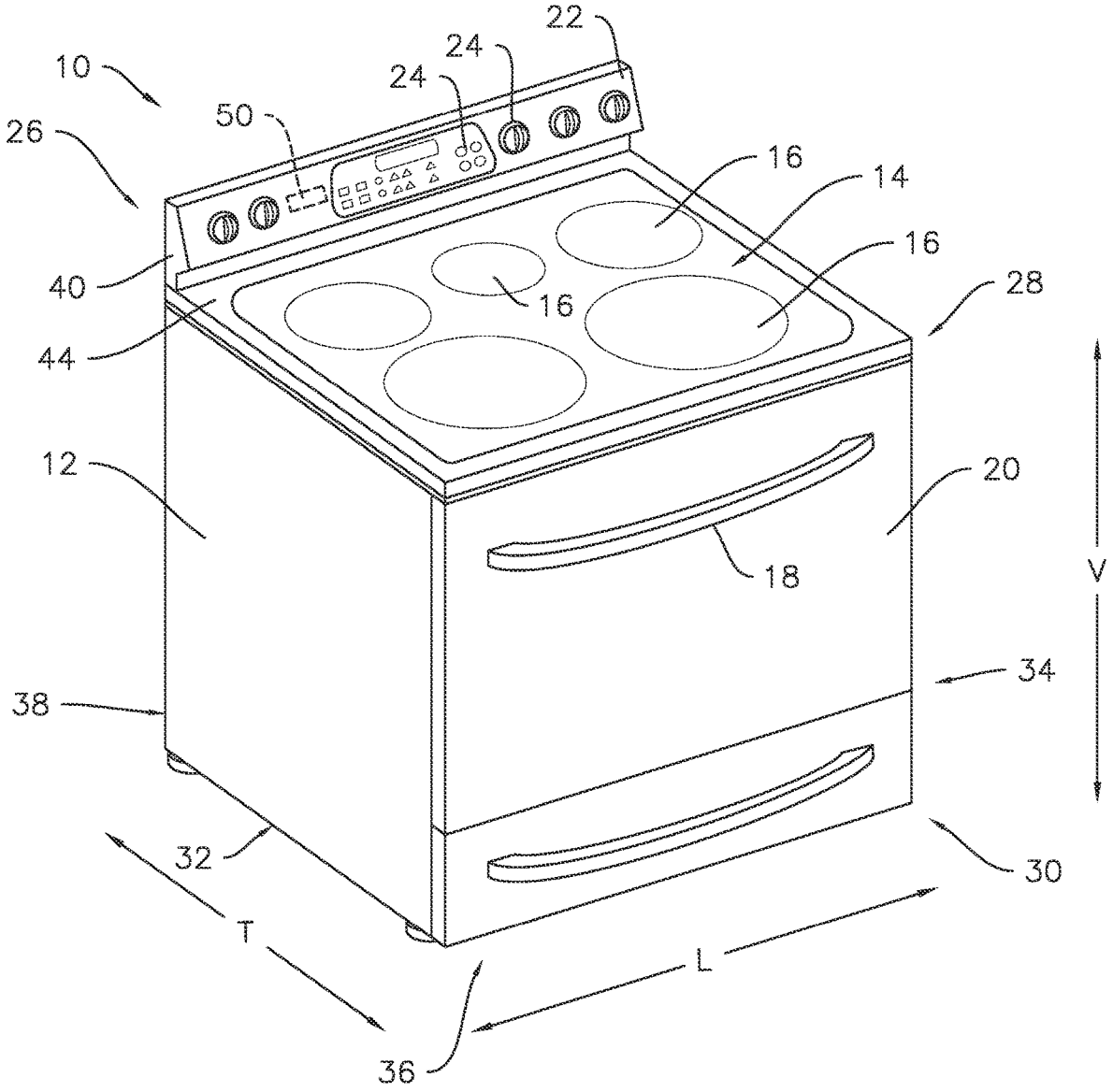
FIG. 1 provides a perspective view of an oven appliance according to one or more exemplary embodiments of the present subject matter.

Reference now will be made in detail to embodiments of the invention, one or more examples of which are illustrated in the drawings. Each example is provided by way of explanation of the invention, not limitation of the invention.

In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise. Terms such as "left," "right," "front," "back," "top," or "bottom" are used with reference to the perspective of a user accessing the oven appliance. For example, a user stands in front of the oven appliance to open the door(s) and access the cooking chamber(s) within the oven appliance.

FIG. 1 provides a perspective view of an oven appliance 10 according to an exemplary embodiment of the present subject matter. As may be seen, e.g., in FIG. 1, oven appliance 10 defines a vertical direction V, a lateral direction L and a transverse direction T. The vertical direction V, the lateral direction L and the transverse direction T are mutually perpendicular and form an orthogonal direction system. Oven appliance 10 is provided by way of example only and is not intended to limit the present subject matter to the arrangement shown in FIG. 1. Thus, the present subject matter may be used with other oven appliance configurations, e.g., double oven appliances, oven appliances having differently arranged burners, etc.

As seen, e.g., in FIG. 1, the oven appliance includes a housing or cabinet 12. The cabinet 12 extends between a top portion 28 and a bottom portion 30 along the vertical direction V, between a left side 32 and a right side 34 along the lateral direction L, and between a front portion 36 and a back portion 38 along the transverse direction T.

A cooking surface 14 may be provided at or near the top portion 28 of cabinet 12. The cooking surface 14 includes a plurality of heating elements 16 disposed within a maintop 44. The maintop 44 may be connected to the cabinet 12 at top portion 28. For the embodiment depicted, the oven appliance 10 includes five heating elements 16 spaced along cooking surface 14. The heating elements 16 may be electric heating elements. In certain exemplary embodiments, oven appliance 10 may be an induction appliance with induction heating elements or coils mounted below cooking surface 14. However, in other embodiments, the oven appliance 10 may include any other suitable shape, configuration, and/or number of heating elements 16. Additionally, in other embodiments, the oven appliance 10 may include any other suitable type of heating element 16, such as one or more gas burners or resistance heating elements. Each of the heating elements 16 may be the same type of heating element 16, or oven appliance 10 may include a combination of different types of heating elements 16.

Figure 2:
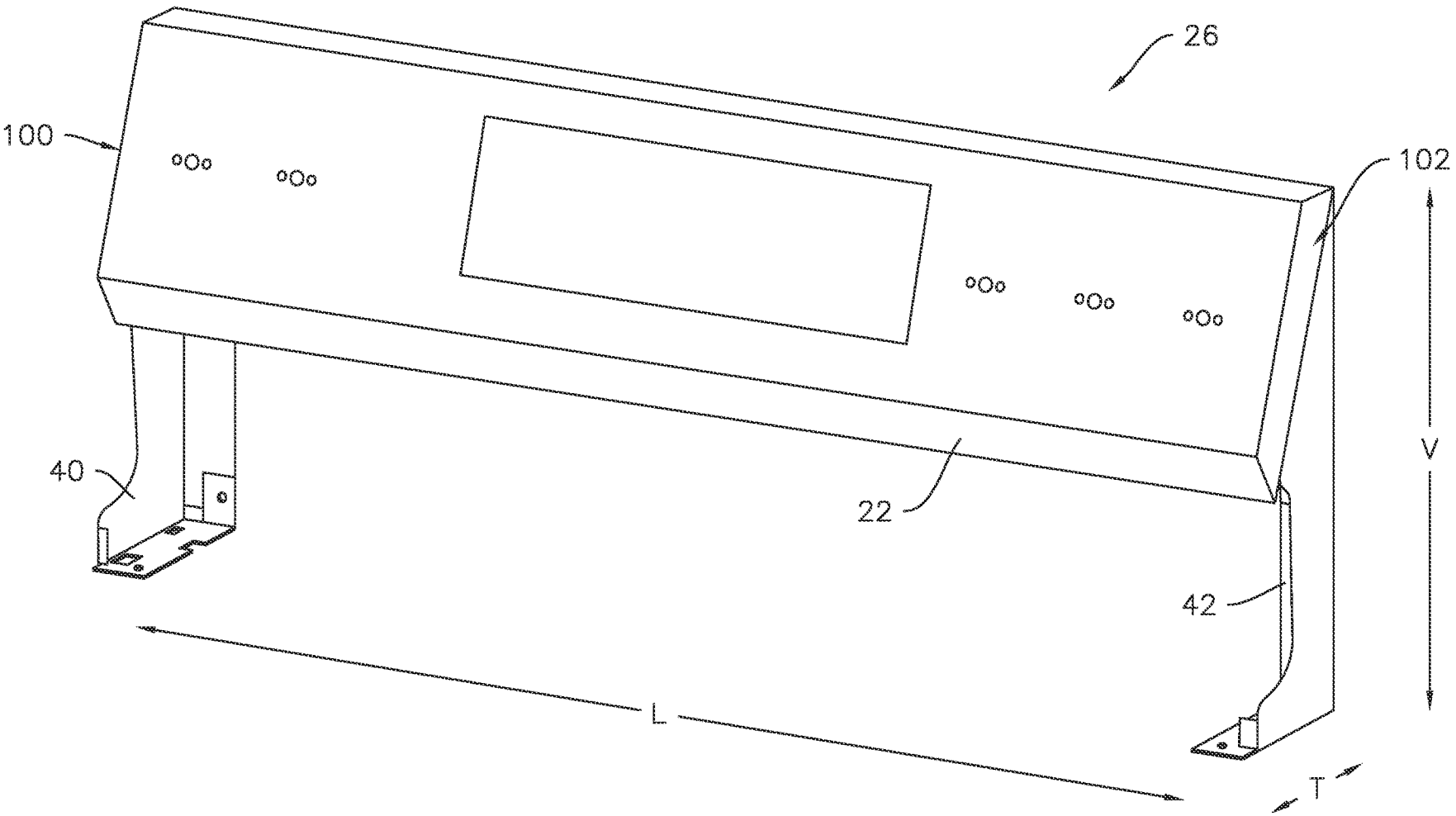
FIG. 2 provides a perspective view of a backsplash according to one or more exemplary embodiments of the present subject matter, which may be incorporated into an oven appliance such as the exemplary oven appliance of FIG. 1.

Oven appliance 10 also includes a door 20 that permits access to a cooking chamber (not shown) defined within the cabinet 12 of oven appliance 10, e.g., for cooking or baking of food items therein. A handle 18 is mounted to door 20 and assists a user with opening and closing door 20. A control panel 22 having controls 24 permits a user to make selections for cooking of food items. The control panel 22 may be positioned on a backsplash 26 of oven appliance 10. As shown in FIGS. 1 and 2, the backsplash 26 of the oven appliance 10 may include the control panel 22, 44, a first end plate 40, and a second end plate 42. Controls 24 may include buttons, knobs, and the like, as well as combinations thereof. As an example, a user may manipulate one or more controls 24 to select a temperature and/or a heat or power output for each heating element 16.

The oven appliance 10 may include a controller 50 operably connected to the control panel 22 and controls 24. The controller 50 may be operably connected to each of the plurality of heating elements 16 for controlling a power level and/or heat level of each of the plurality of heating elements 16 in response to one or more user inputs received through the control panel 22 and controls 24. The controls 24 may be configured in wired or wireless communication with the controller 50. Signals generated in controller 50 operate appliance 10 in response to user input via the controls 24.

The controller 50 may generally include a computing device having one or more processor(s) and associated memory device(s). The computing device may be configured to perform a variety of computer-implemented functions to control the exemplary oven appliance 10. The computing device can include a general purpose computer or a special purpose computer, or any other suitable computing device. It should be appreciated, that as used herein, the processor may refer to a controller, a microcontroller, a microcomputer, a programmable logic controller (PLC), an application specific integrated circuit, and other programmable circuits. Additionally, the memory device(s) may generally comprise memory element(s) including, but not limited to, computer readable medium (e.g., random access memory (RAM)), computer readable non-volatile medium (e.g., a flash memory), a compact disc-read only memory (CD-ROM), a magneto-optical disk (MOD), a digital versatile disc (DVD), and/or other suitable memory elements. The memory can store information accessible by processor (s), including instructions that can be executed by processor (s). For example, the instructions can be software or any set of instructions that when executed by the processor(s), cause the processor(s) to perform operations. The instructions may include a software package configured to operate the oven appliance 10.

Further, the controller 50 is operably connected to each of the plurality of heating elements 16 for controlling a power level of each of the plurality of heating elements 16 in response to one or more user inputs through the controls 24. For example, in embodiments wherein one or more of the heating elements 16 are configured as electric resistance heaters, the controller 50 may be operably connected to respective relays, triodes for alternating current, or other devices for controlling an amount of power to such electrical resistance heaters. Alternatively, in embodiments wherein one or more of the heating elements 16 are configured as induction heating elements, the controller 50 may be operably connected to respective current control devices. As yet another example, in embodiments where the heating elements 16 are gas burners, the controller 50 may actuate one or more gas valves (not shown) to adjust a supply of gas to burners 16.

FIG. 2 provides a perspective view of the backsplash 26. As illustrated for example in FIG. 2, the backsplash 26 includes first and second end plates 40 and 42 and control panel 22 connected to and extending between the first and second end plates 40 and 42. The backsplash 26 may further include a back panel 46 (see, e.g., FIGS. 12 and 13) of the cabinet 12. As will be described in more detail below, the control panel 22 may be coupled to the first end plate 40 by a first tab and slot coupling at a left end 100 of the control panel 22 and coupled to the second end plate 42 by a second tab and slot coupling at a right end 102 of the control panel 22.

Figure 3:
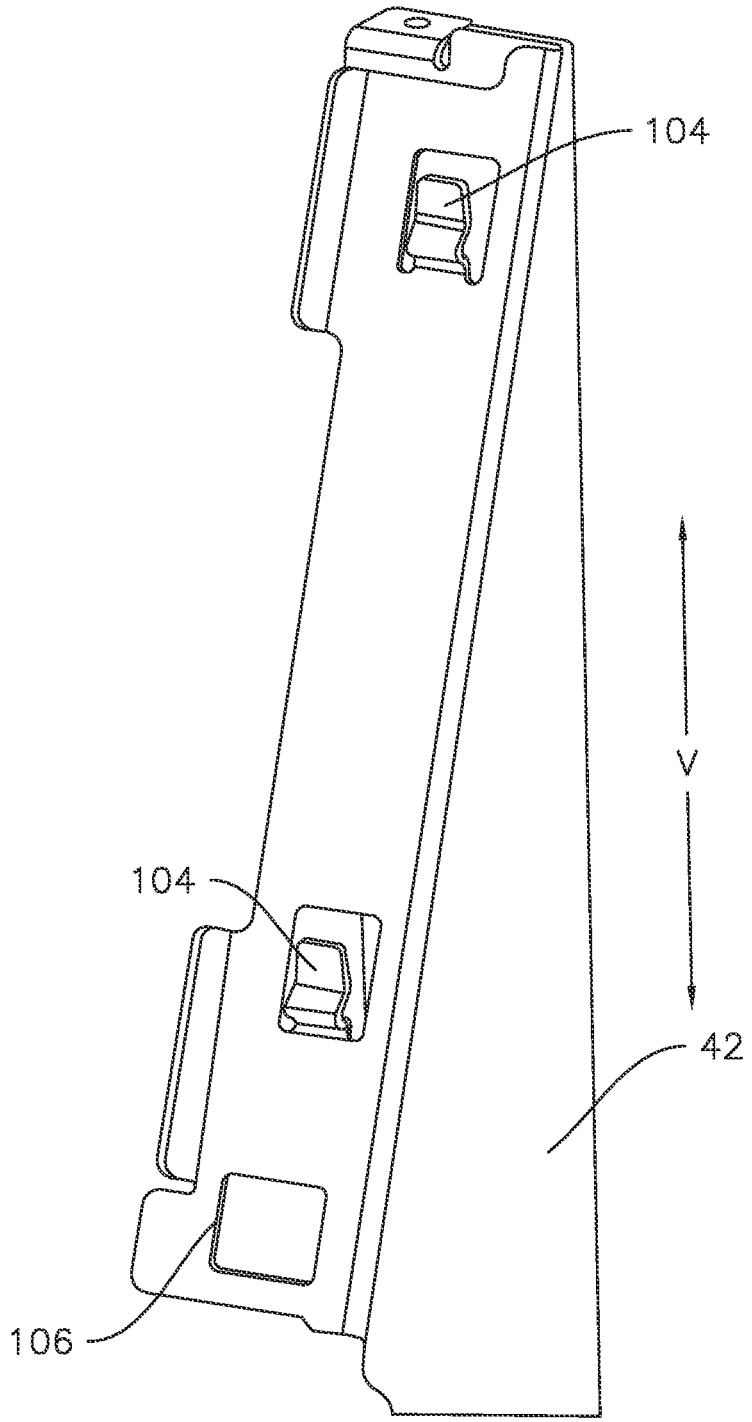
FIG. 3 provides an enlarged view of a portion of an end plate of the backsplash of FIG. 2.

FIG. 3 provides an enlarged perspective view of an upper portion of an exemplary second end plate 42 according to one or more embodiments of the present disclosure. It should be understood that the first end plate 40 and the second end plate 42 are substantially identical, e.g., are mirrored. As illustrated in FIG. 3, the end plate 42 may include an outer panel that extends generally along the vertical direction V and the transverse direction T when assembled to the cabinet 12, e.g., generally coplanar with a right side of the cabinet 12 when assembled. The end plate 42 may also include an oblique flange, e.g., oriented at an oblique angle to the vertical direction V, extending along the lateral direction L from the outer panel of the end plate 42, e.g., towards a center of the oven appliance 10 when assembled. The end plate 42 may further include one or more sliding retention tabs 104 on the oblique flange thereof. For example, the end plate 42 may include two sliding retention tabs 104, e.g., a pair of sliding retention tabs 104. In some embodiments, the sliding retention tabs may be generally colinear, e.g., may be aligned along a longitudinal direction of the oblique flange of the end plate 42, such as offset by no more than 10% of a width of each tab 104 along a direction perpendicular to the longitudinal direction of the oblique flange. The end plate 42 may also include a slot 106 in the oblique flange.

Figure 4:
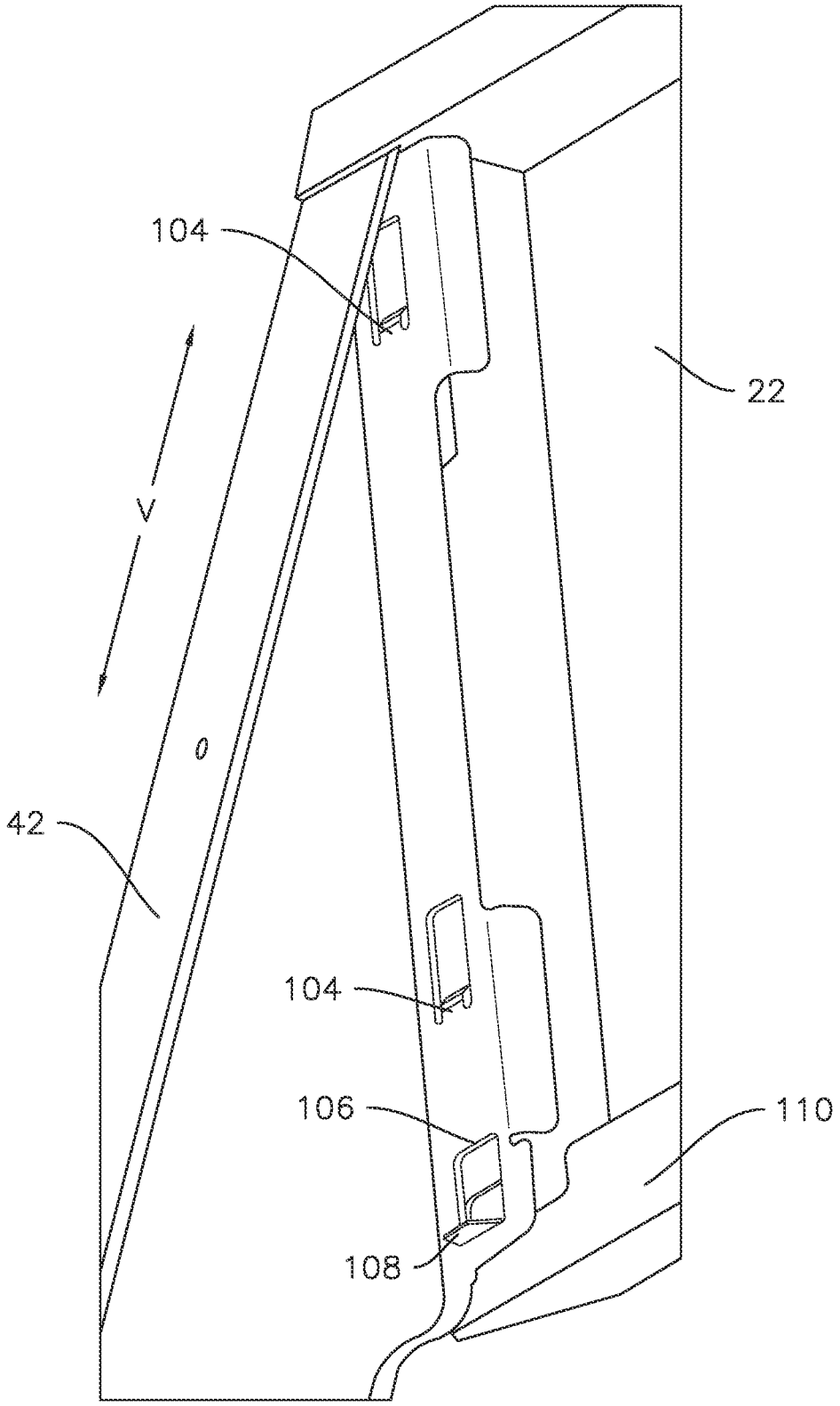
FIG. 4 provides a perspective view of a portion of an end plate and a connected portion of a control panel of the backsplash of FIG. 2.
Figure 5:
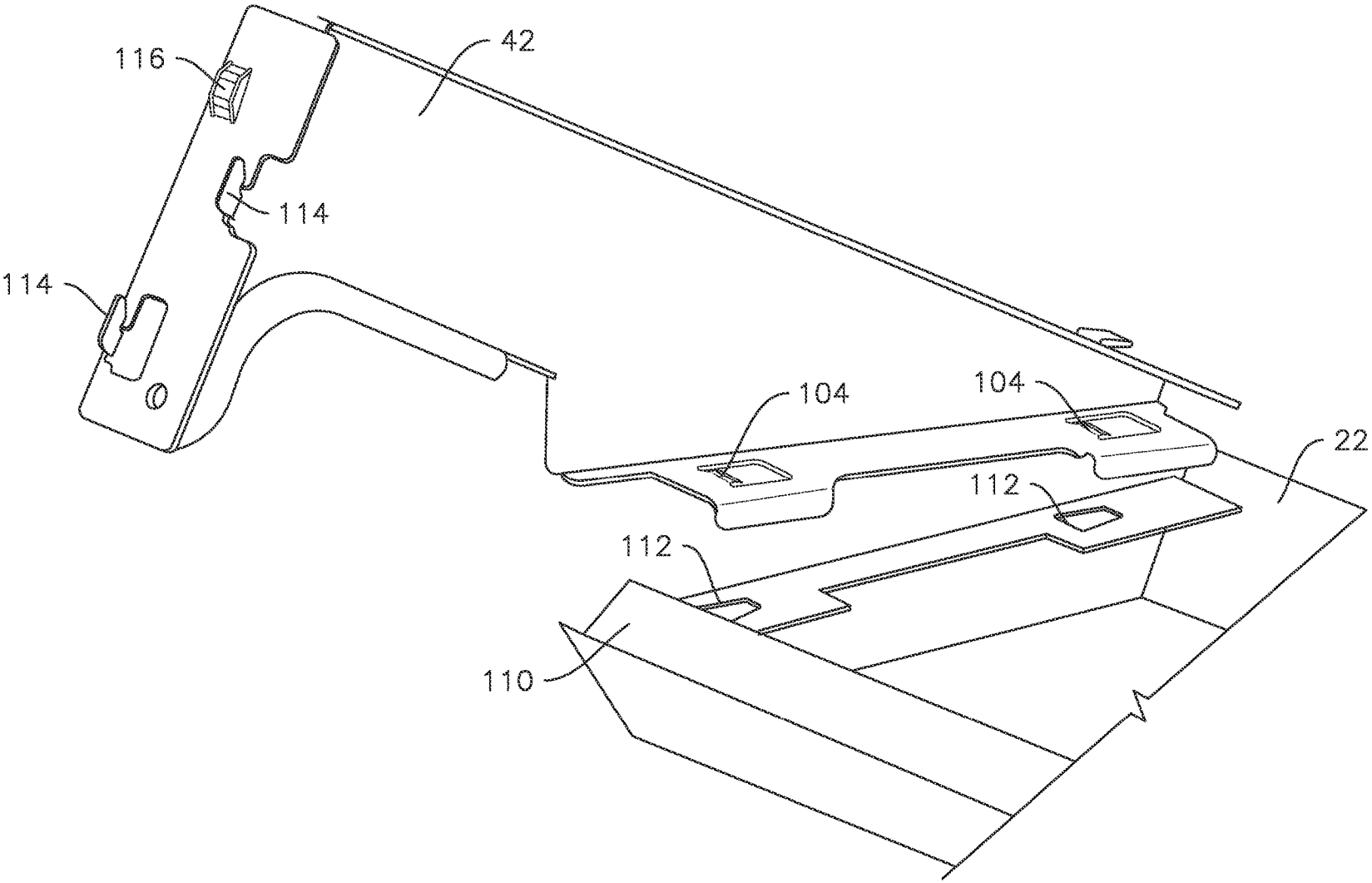
FIG. 5 provides a perspective view of the end plate and control panel during assembly.

As may be seen in FIGS. 4 through 8, the control panel 22 may include one or more slots 112 therein, e.g., on a back side of the control panel 22, such as on a rear side flange of the control panel 22. For example, FIG. 5 illustrates the slots 112 at the right end 102 of the control panel 22. It is to be understood that the left end 100 of the control panel 22 is substantially identical to, e.g., a mirror image of, the right end 102. The slots 112 at each end of the control panel 22 generally correspond to the sliding retention tabs 104 on each end plate 40 and 42, e.g., the slots 112 at the left end 100 correspond to the sliding retention tabs 104 on the first end plate 40 and the slots 112 at the right end 102 correspond to the sliding retention tabs 104 on the second end plate 42. For example, the slots 112 may correspond to the sliding retention tabs 104 in number, size, shape, and position. In some embodiments, the slots 112 may have a wider bottom end, to promote ease of initial insertion of each tab 104 into each respective slot 112, and a narrower top end which is sized to correspond to a width of the respective tab 104, thereby securing the control panel 22 to the end plates 40 and 42 when the sliding retention tabs 104 on the end plates 40 and 42 are each received within a respective slot 112 on the control panel 22.

As may be seen, e.g., in FIG. 4, in some embodiments, the control panel 22 may include a compression tab 108 formed on a bottom flange 110 thereof. The compression tab 108 may be received in the slot 106 of the end plate 42. As mentioned, the first end plate 40 may be a mirror image of the second end plate 42 and the left end 100 of the control panel 22 may be a mirror image of the right end 102 of the control panel 22. Thus, the control panel 22 may include two compression tabs 108 on opposite ends of the bottom flange 110, and each compression tab 108 may be received within a corresponding slot 106 on one of the end plates 40 and 42.

As shown in FIGS. 5 through 8, the second end plate 42 may be slidingly coupled to the control panel 22. For example, the sliding retention tabs 104 may be inserted into each slot 112 at the wider bottom end thereof, and the end plate 42 may then be translated, e.g., slid, towards the top of the control panel 22, whereby the taper of the slots from the wider bottom end to the narrower top end aligns the end plate 42 with the control panel 22 as the tabs 104 are slid into place, e.g., into the connected position illustrated in FIGS. 7 and 8.

Figure 6:
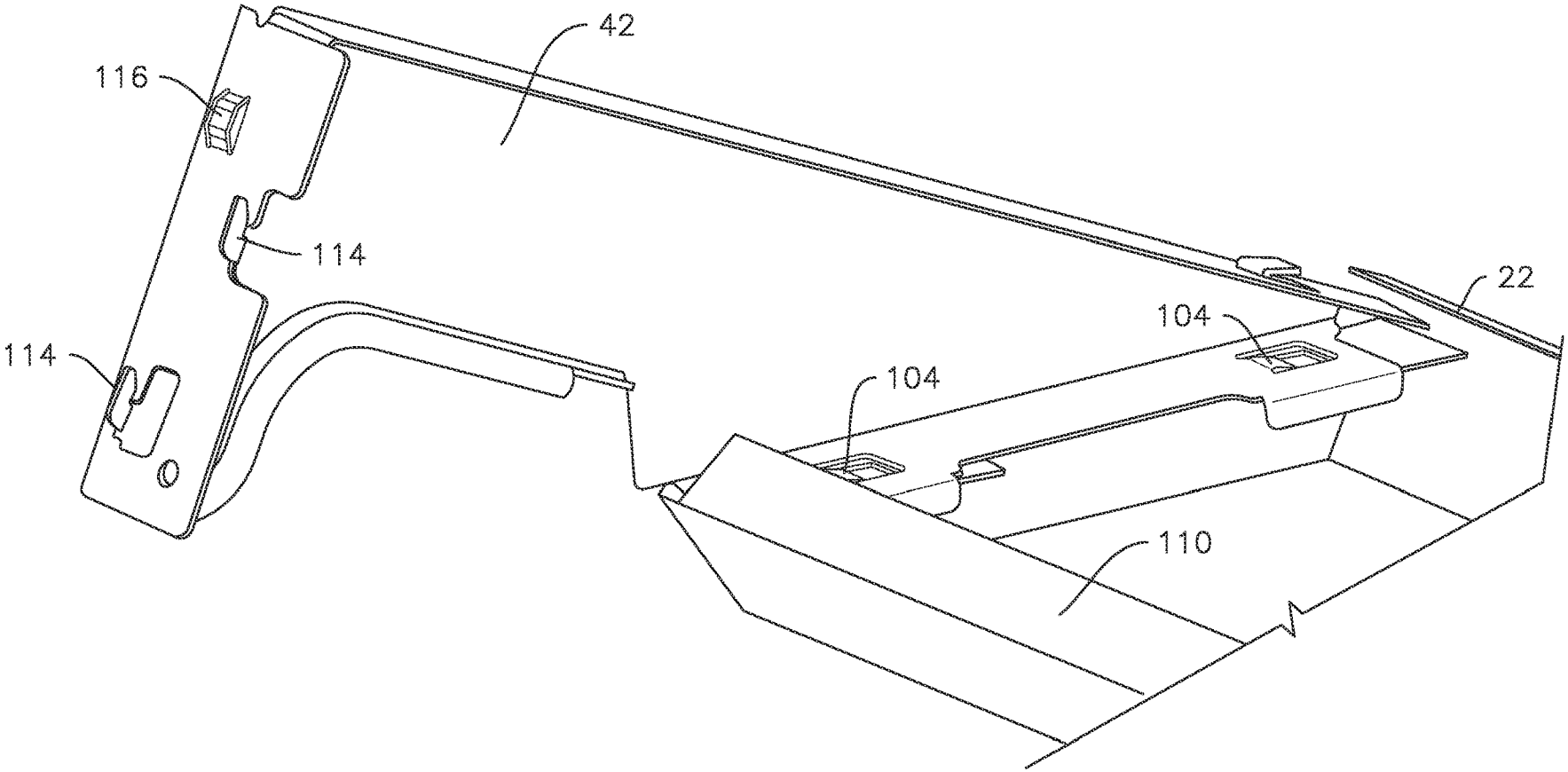
FIG. 6 provides a perspective view of the end plate and control panel at a subsequent point during assembly after the position illustrated in FIG. 5.
Figure 7:
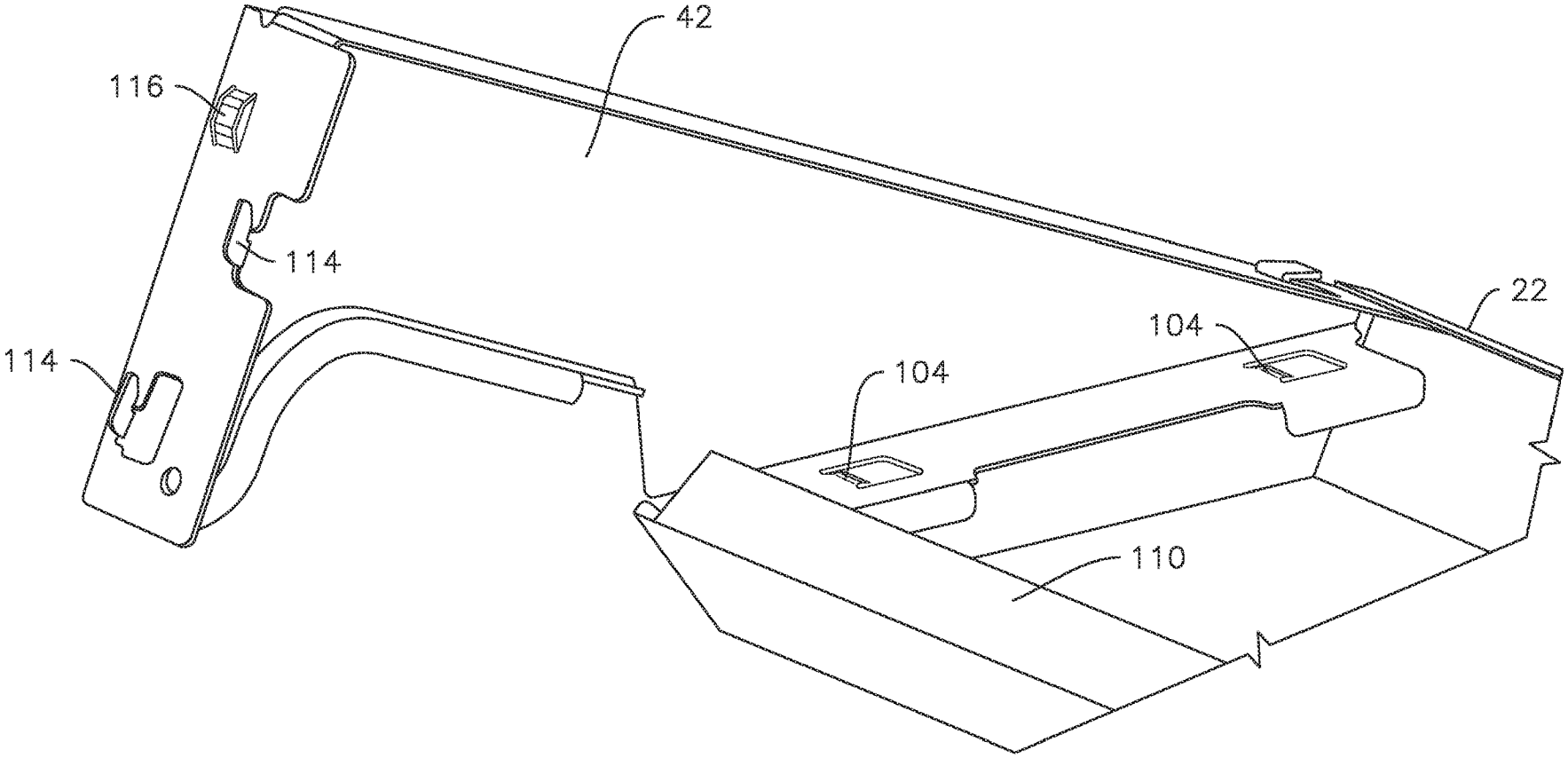
FIG. 7 provides a perspective view of the end plate and control panel as connected after assembly.
Figure 8:
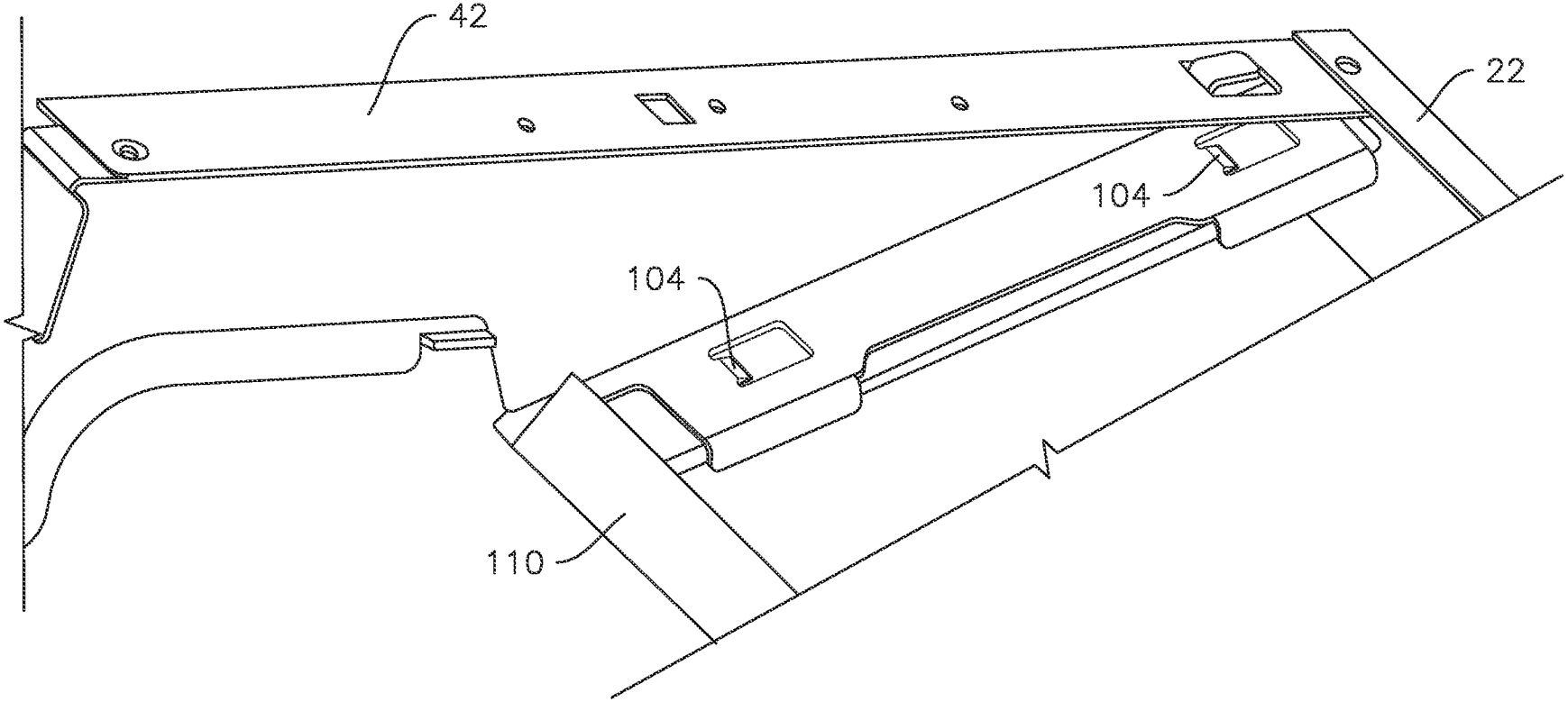
FIG. 8 provides another perspective view of the end plate and control panel of FIG. 7.

In particular, FIG. 5 illustrates the end plate and the control panel 22 in alignment position, from which the sliding retention tabs 104 may be initially lined up with and inserted into their corresponding slots 112, to reach the intermediate position illustrated in FIG. 6. From the intermediate position illustrated in FIG. 6, the end plate 42 may be slid, e.g., translated along a straight line generally parallel to the longitudinal direction of the oblique flange of the end plate 42, into place, until the end plate 42 is fully coupled to and engaged with the control panel 22 by the sliding retention tabs 104 at the top end of each respective slot 112, e.g., as illustrated in FIGS. 7 and 8.

Figure 10:
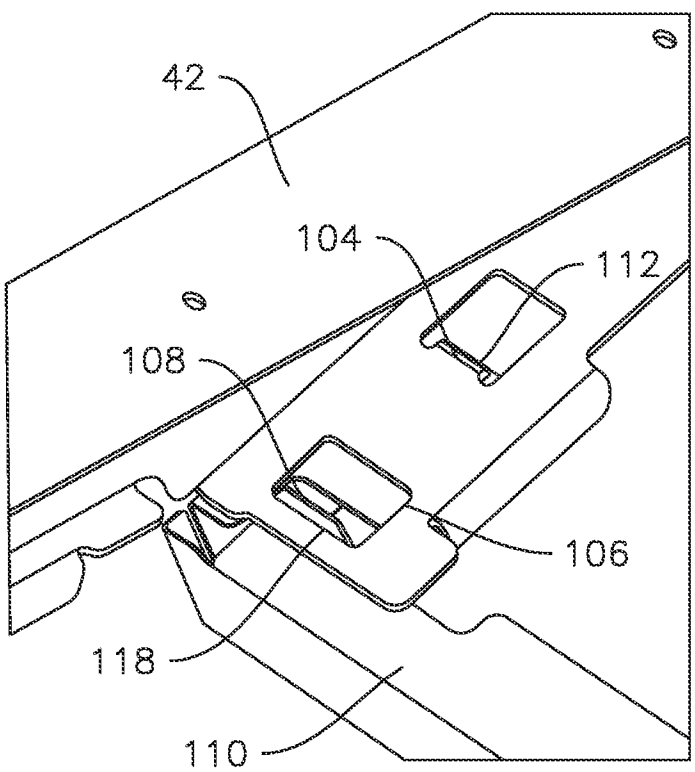
FIG. 10 provides an enlarged perspective view of portions of the end plate and control panel as connected after assembly.
Figure 9:
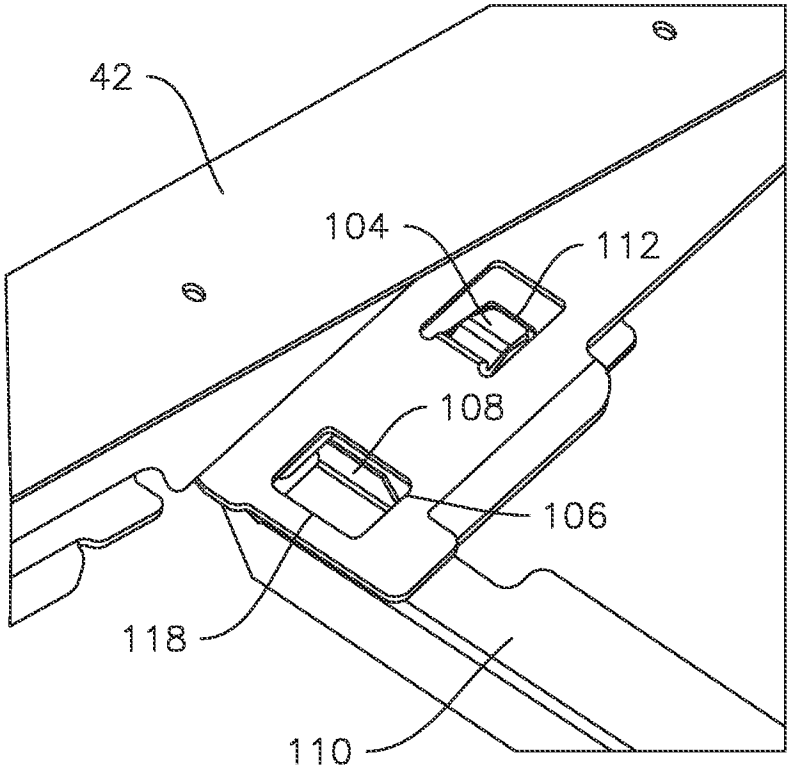
FIG. 9 provides an enlarged perspective view of portions of the end plate and control panel during assembly.

FIGS. 9 and 10 provide an enlarged view of the compression tab 108 and slot 106. As mentioned above, the control panel 22 may include one or more compression tabs 108 on the bottom flange 110 of the control panel 22 and the end plates 40 and 42 may each include one or more slots 106 corresponding to the compression tab(s) 108. As shown in FIG. 9, when the end plate 42 is aligned with the control panel 22, such as in the intermediate position described above with respect to FIG. 6, the compression tab 108 is received freely within the slot 106 on the end plate 42. As shown in FIG. 10, when the end plate 42 is coupled to the control panel 22 by the tabs 104 and slots 112, e.g., as described above with respect to FIGS. 7 and 8, the compression tab 108 may abut and bear against a lower edge 118 of the slot 106, thereby compressing, e.g., pulling, the bottom flange 110 upwards, such as to minimize a gap between the bottom of the control panel 22 and a face of the control panel 22

Figure 11:
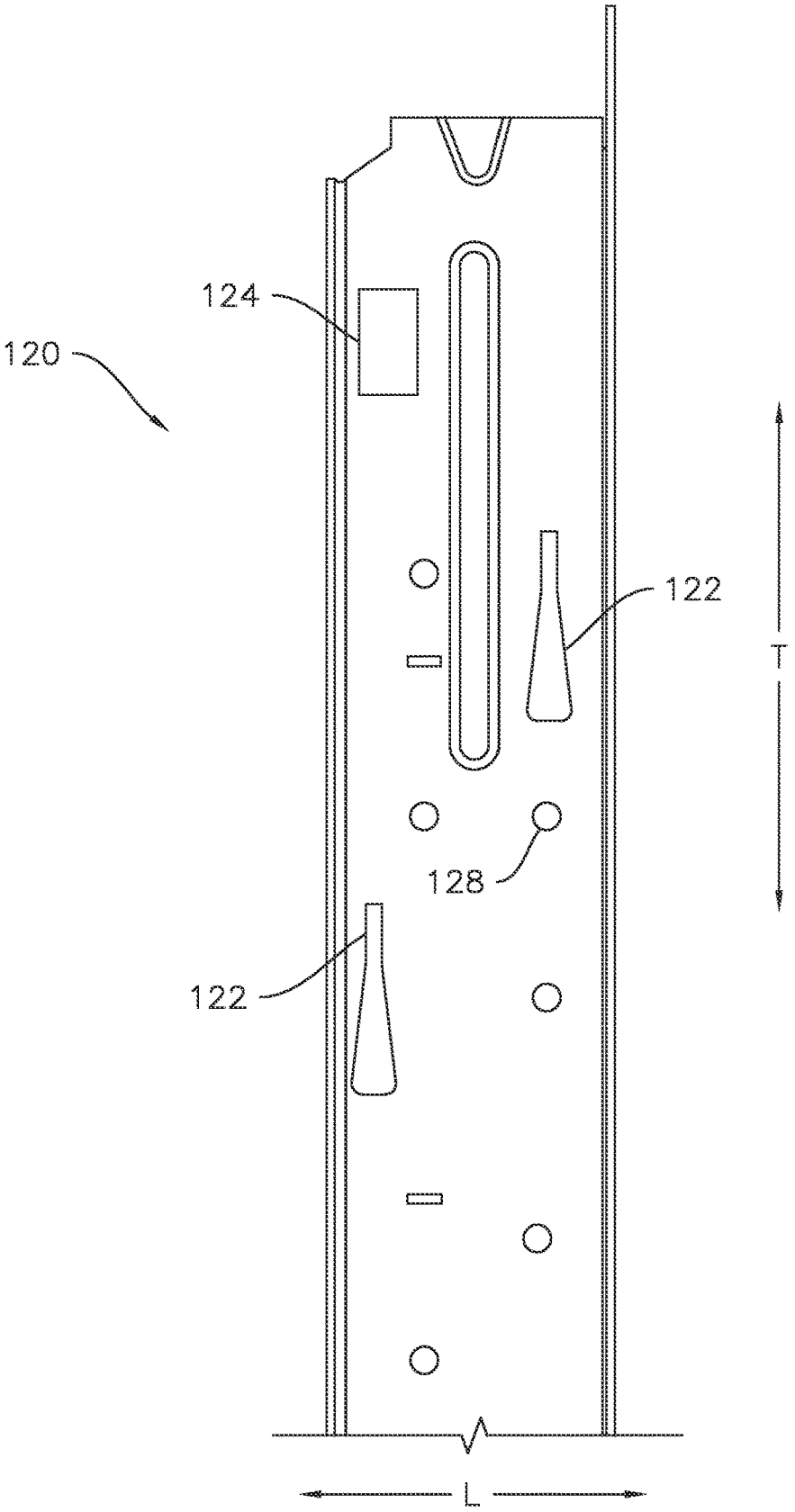
FIG. 11 provides a top view of a portion of a brace for an oven appliance such as the exemplary oven appliance of FIG. 1.

As illustrated for example in FIG. 11, the oven appliance 10 may include a brace 120, and the brace may be mounted to the cabinet 12 along the transverse direction T, such as the brace 120 may be one of a pair of braces 120 mounted to opposite upper corners of the cabinet 12 and extending across the depth of the cabinet 12 from front to back. For example, a first brace 120 may be mounted to the cabinet 12 at the top portion 28 of the cabinet 12, when so mounted, the first brace 120 may extend along the left side 32 of the cabinet 12 between the front portion 36 of the cabinet 12 and the back portion 38 of the cabinet 12, and a second brace 120 may be mounted to the cabinet 12 at the top portion 28 of the cabinet 12, when so mounted, the second brace 120 may extend along the right side 34 of the cabinet 12 between the front portion 36 of the cabinet 12 and the back portion 38 of the cabinet 12. In some embodiments, the first brace 120 and the second brace 120 may extend along all or substantially all of the depth of the cabinet 12, e.g., from the front portion 36 of the cabinet 12 to the back portion 38 of the cabinet 12. As used herein, "substantially" means at least ninety percent (90%). In other embodiments, the first brace 120 and the second brace 120 may extend along about three quarters of the depth of the cabinet 12, or about half of the depth of the cabinet 12, or about one quarter of the depth of the cabinet 12. As used herein, "about" means within ten percent of the stated value, e.g., "about three quarters" includes from sixty-five percent (65%) to eighty-five percent (85%). One of ordinary skill in the art will recognize that the first brace 120 and the second brace 120 may encompass any suitable sizes or dimensions to provide structural support and stability to the cabinet 12.

FIG. 11 illustrates a left brace 120, or first brace as described above. It should be understood that the second brace or right brace 120 is substantially identical to, e.g., a mirror image of, the illustrated left brace 120. As illustrated in FIG. 11, the brace 120 may include one or more tapered alignment slots 122 and one or more locking cutouts 124. The first end plate 40 and second end plate 42 may be mounted to the cabinet 12, such as to the braces 120 therein, by hook and slot couplings, as will be described in more detail below.

Figure 12:
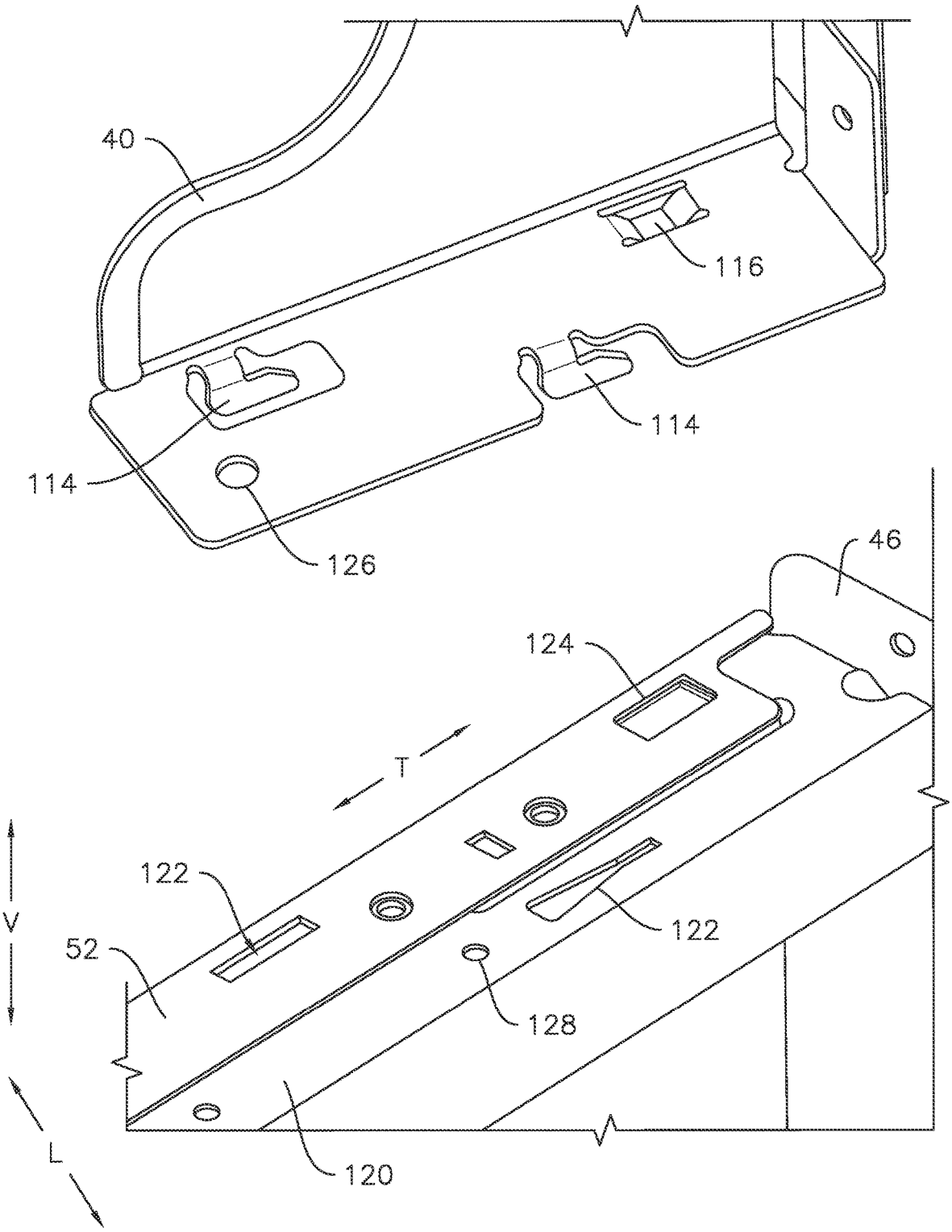
FIG. 12 provides a perspective view of the end plate, brace, and cabinet during assembly.
Figure 13:
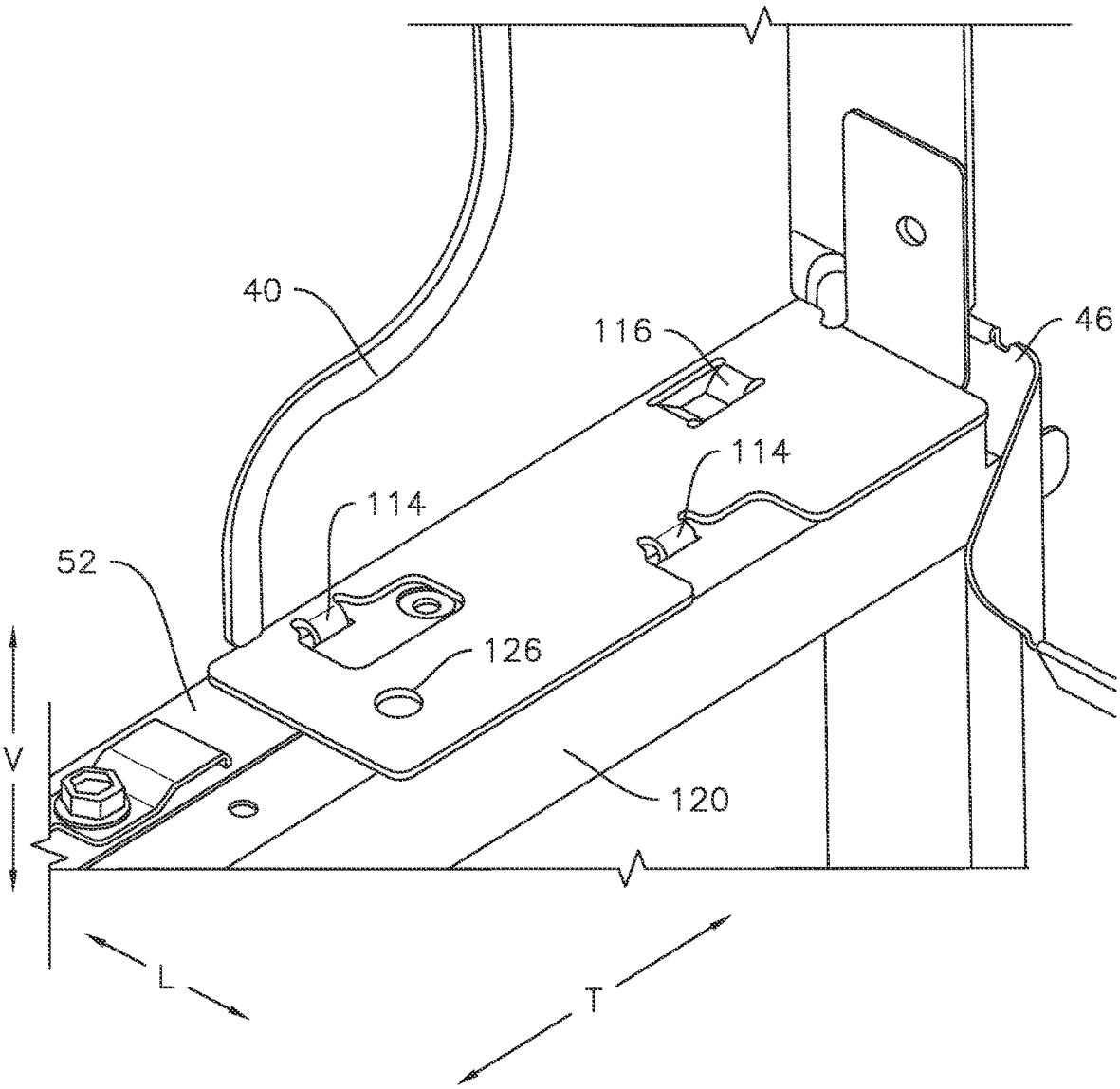
FIG. 13 provides a perspective view of the end plate, brace, and cabinet at a subsequent point during assembly after the position illustrated in FIG. 12.

As may be seen in FIGS. 12 and 13, the end plate 40 may include a horizontal base, e.g., a base that extends along its two largest dimensions generally perpendicularly to the vertical direction V, such as in a lateral-transverse plane defined by the lateral direction L and the transverse direction T. The end plate 40 may also include one or more hooks 114 on the base of the end plate 40, and the one or more hooks 114 may correspond to the slots 122 of the brace 120, e.g., in size, shape, and location, in a similar manner as described above with respect to the slots 112 of the control panel 22 that correspond to the sliding retention tabs 104 on the end plates 40 and 42. Thus, the first end plate 40 may be mounted to the cabinet 12 by a first hook and slot coupling at the top portion 28 of the cabinet 12, e.g., the first hook and slot coupling may include the one or more hooks 114 on the first end plate 40 and the corresponding one or more slots 122 on the left brace 120, and the second end plate 42 may be mounted to the cabinet 12 by a second hook and slot coupling at the top portion 28 of the cabinet 12, e.g., the second hook and slot coupling may include the one or more hooks 114 on the second end plate 42 and the corresponding one or more slots 122 on the right brace 120. Further, as may be seen in FIGS. 1 and 2, when assembled, the first end plate 40 extends along the left side 32 of the cabinet 12 between the front portion 36 of the cabinet 12 and the back portion 38 of the cabinet 12, and the second end plate 42 extends along the right side 34 of the cabinet 12 between the front portion 36 of the cabinet and the back portion 38 of the cabinet 12.

In some embodiments, each end plate 40 and 42 may include multiple hooks 114 thereon, such as a pair of hooks 114 on each end plate 40 and 42. For example, the pair of hooks 114 on each end plate 40 and 42 may be laterally offset from each other. Such lateral offset of the hooks 114 may reduce or prevent rotation, e.g., twisting, about the vertical direction V of the backsplash 26 relative to the cabinet 12. Additionally, a bridge lance 116 on the end plate 40 may be received within a cutout 124 of the brace 120, and the engagement of the bridge lance 116 within the cutout 124 may further align the backsplash 26 on and with the cabinet 12 and prevent relative rotation between the backsplash 26 and cabinet 12. In particular, the bridge lance 116 may be engaged with and/or constrained between two sides of the cutout 124 that extend generally along the transverse direction T to provide lateral alignment of the backsplash 26 on the cabinet 12, e.g., such that each end plate 40 and 42 is generally flush with a corresponding one of a left side panel and a right side panel of the cabinet 12.

Also illustrated in FIG. 12 is a left flange 52 of the cabinet 12 disposed along the left side 32 of the cabinet 12 at the top portion 28 of the cabinet 12. The brace 120 may be mounted to the cabinet 12 above, e.g., on top of, the left flange 52 with the flange 52 on top of the brace 120. Accordingly, the flange 52 may also include corresponding apertures through which the hooks 114 and the bridge lance 116 extend in order to engage the corresponding slots 122 and cutout 124 in the brace 120.

Also as may be seen in FIGS. 12 and 13, in some embodiments, the end plate 40 may include a locking aperture 126 and the brace 120 may include a mating aperture 128 that corresponds to the locking aperture 126, e.g., the mating aperture 128 may correspond to the locking aperture 126 by generally matching the size, shape, and location (in the installed, assembled position) of the locking aperture 126, e.g., where corresponding is used in the same sense as described above with respect to the tabs 104 and slots 112 and the hook 114 and slots 122. For example, as may be seen in FIGS. 13 and 14, when the end plate 40 is assembled to and fully connected (engaged) with the cabinet 12, e.g., the brace 120 thereof, the locking aperture 126 and the mating aperture 128 may be generally aligned, e.g., generally concentric, such as having the centers thereof offset by no more than ten percent of the diameter of one or both of the aperture 126 and 128. When so assembled, the end plate 40 may then be secured, e.g., locked or fixed, to the cabinet 12 by a fastener, such as a screw, through the locking aperture 126 and the mating aperture 128. For example, one or both of the locking aperture 126 and the mating aperture 128 may include internal threads formed thereon for engaging with the screw. Thus, with each end plate 40 and 42 coupled to the cabinet 12 as described and the control panel 22 coupled to each end plate 40 and 42 as described above, the backsplash 26 may thereby be mounted atop the cabinet 12 by the hook and slot coupling of the end plates 40 and 42 to the braces 120, with the control panel 22 coupled to the end plates 40 and 42 by the tab and slot couplings described above.

Figure 14:
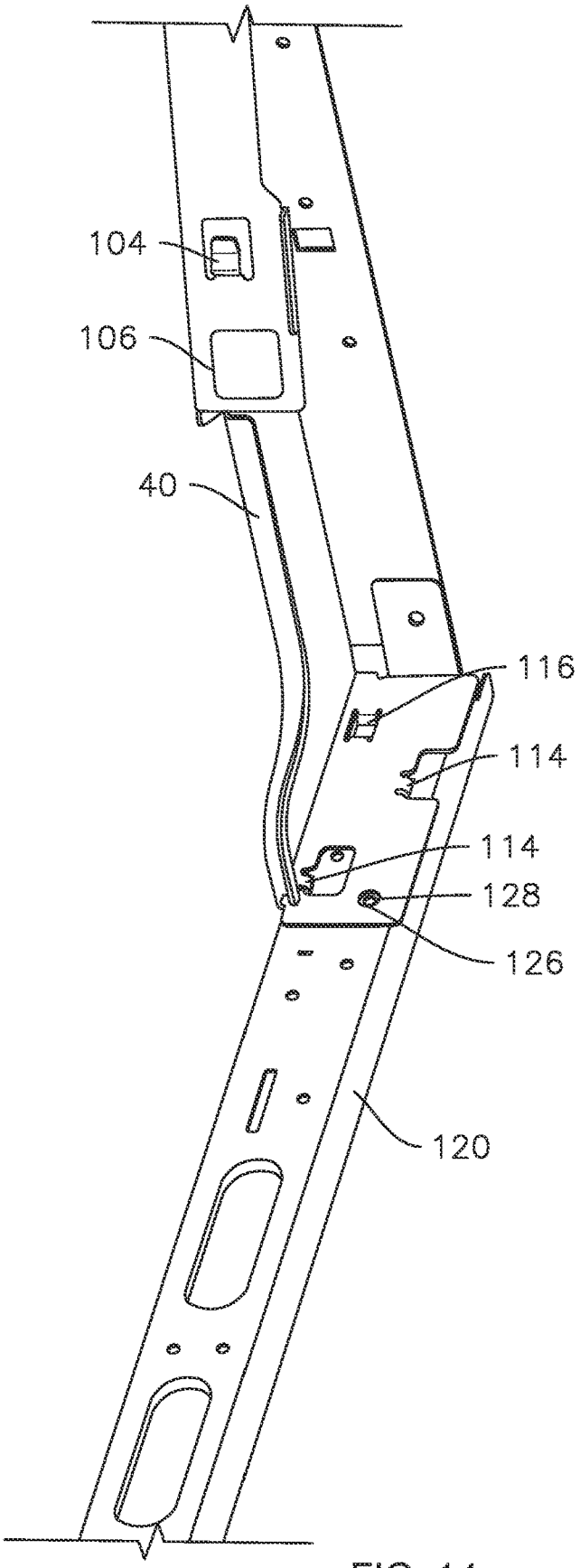
FIG. 14 provides a perspective view of the end plate and brace connected together.

As may be seen, e.g., in FIGS. 13 and 14, when assembled, the locking aperture 126 and the mating aperture 128 are oriented along the vertical direction V to receive a vertically-oriented screw through both of the apertures 126 and 128. As mentioned, the end plates 40 and 42 may be mirrored, as well as the braces 120 may also be mirrored. Accordingly, the backsplash 26 may be assembled to the cabinet 12 with two vertically-oriented screws, e.g., one through the apertures 126 and 128 on the first end plate 40 and the left brace 120, and a second through the apertures 126 and 128 of the second end plate 42 and the left brace 120. In some embodiments, the two screws may be the only screws used to assemble the backsplash 26 and mount the backsplash 26 to the cabinet 12. Optionally, the backsplash 26 may be assembled with two additional screws, e.g., each end plate 40 and 42 may be fastened to the control panel 22 with a single screw, while the two screws through the apertures 126 and 128 in each end plate 40 and 42 and each brace 120 are the only screws used to mount the backsplash 26 to the cabinet 12. Thus, the backsplash 26, e.g., the end plates 40 and 42 thereof, may be mounted to the cabinet 12 without any horizontally-oriented screws or other similar reversible fasteners, such as bolts. In some embodiments, the backsplash 26, e.g., the end plates 40 and 42 thereof, may be mounted to the cabinet 12 without being fastened to the back panel 46, e.g., without any screws or other similar reversible fasteners, such as bolts, connecting the end plates 40 and 42 to the back panel 46. By minimizing the use of screws, and providing screws which are accessible from the front of the oven appliance 10, the oven appliance 10 may be more easily assembled and more easily disassembled, e.g., for maintenance.

Figure 15:
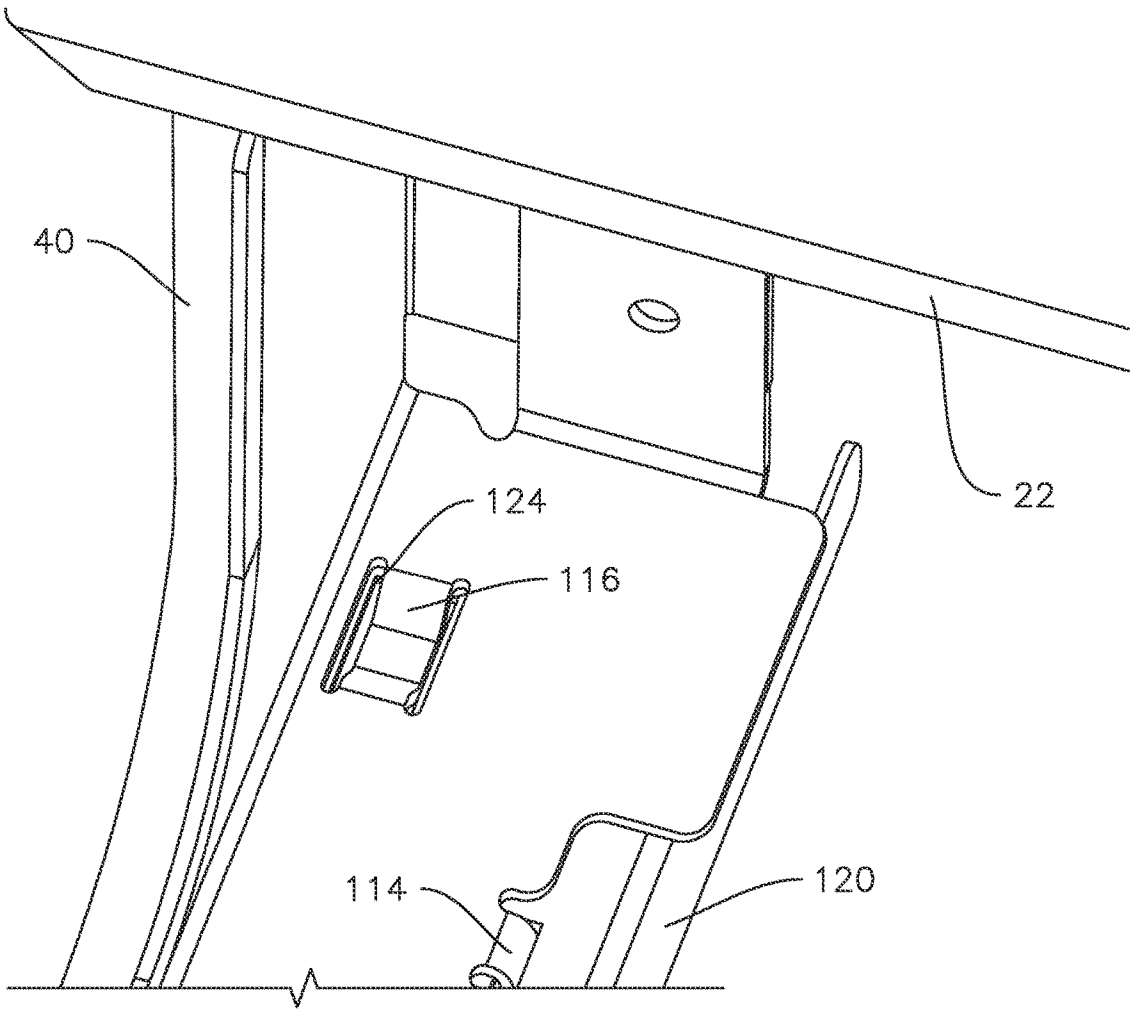
FIG. 15 provides an enlarged perspective view of portions of the control panel, end plate, and brace connected together.
Figure 16:
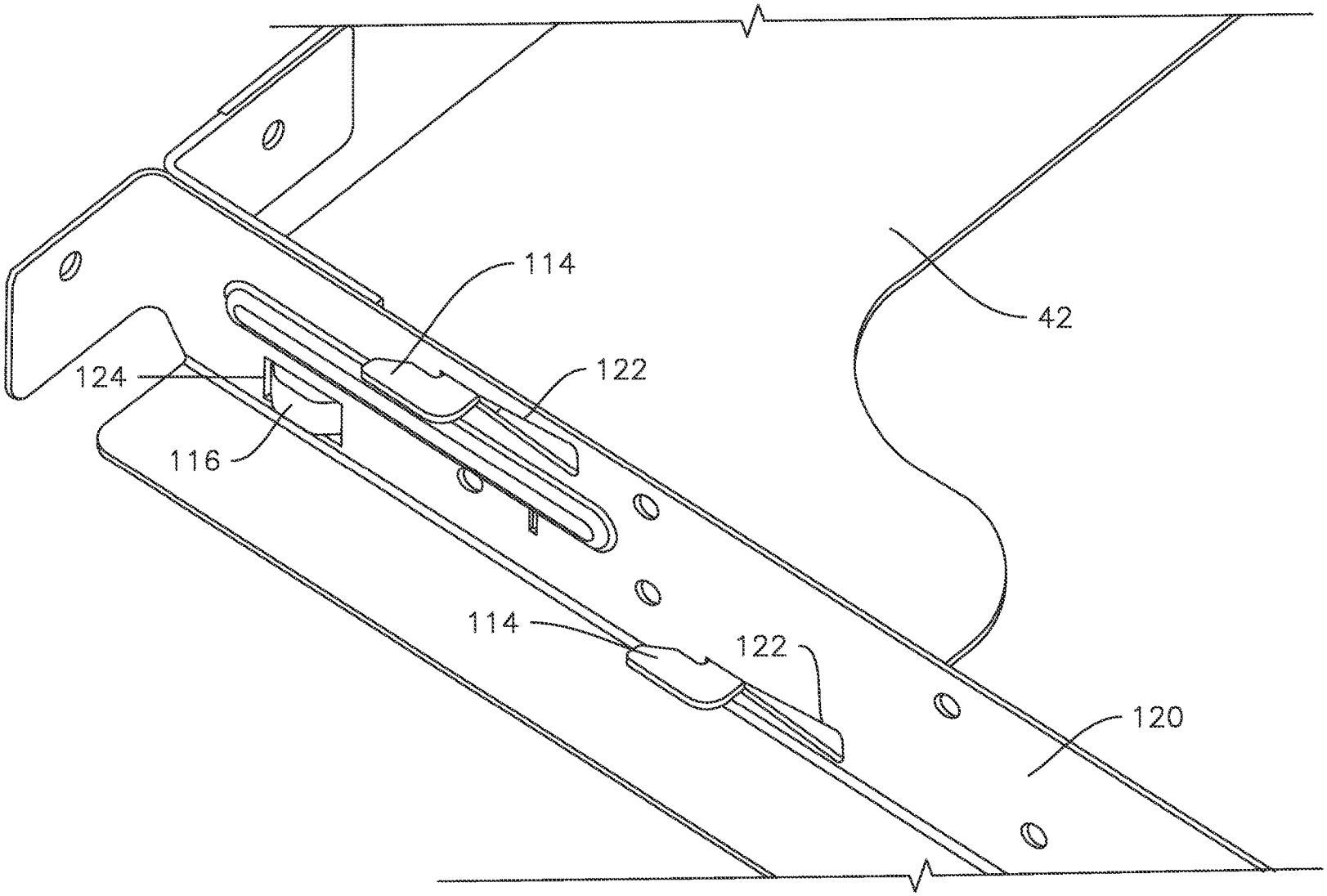
FIG. 16 provides a bottom perspective view of the end plate and brace connected together.

As mentioned above, a bridge lance 116 may be provided to engage a cutout 124 on each brace 120 to promote alignment and location of the backsplash 26 with and on the cabinet 12. FIG. 15 illustrates a top view of an exemplary first bridge lance 116 on the first end plate 40. The first bridge lance 116 may be received in the cutout 124 in the first brace (left brace) 120 of the cabinet 12. FIG. 16 illustrates a bottom view of a second bridge lance 116 on the second end plate 42, where the second bridge lance 116 is received in a cutout 124 in the second brace (right brace) 120 of the cabinet 12.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance defining a lateral direction, a transverse direction, and a vertical direction, the lateral direction, the transverse direction, and the vertical direction are mutually perpendicular, the oven appliance comprising:

a cabinet extending between a top portion and a bottom portion along the vertical direction, between a left side and a right side along the lateral direction, and between a front portion and a back portion along the transverse direction;

a first end plate mounted to the cabinet by a first hook and slot coupling at the top portion of the cabinet and extending along the left side of the cabinet between the front portion of the cabinet and the back portion of the cabinet;

a second end plate mounted to the cabinet by a second hook and slot coupling at the top portion of the cabinet and extending along the right side of the cabinet between the front portion of the cabinet and the back portion of the cabinet; and a back panel of the cabinet positioned at the back portion of the cabinet, wherein the first end plate is mounted to the cabinet without being fastened to the back panel, and wherein the second end plate is mounted to the cabinet without being fastened to the back panel.

2. The oven appliance of claim 1, further comprising a control panel coupled to the first end plate by a first tab and slot coupling at a left end of the control panel and coupled to the second end plate by a second tab and slot coupling at a right end of the control panel.

3. The oven appliance of claim 2, wherein the first tab and slot coupling comprises a first pair of sliding retention tabs on the first end plate received in a pair of slots at the left end of the control panel and a second pair of sliding retention tabs on the second end plate received in a pair of slots at the right end of the control panel.

4. The oven appliance of claim 2, further comprising a first compression tab on a bottom flange of the control panel received in a slot of the first end plate and a second compression tab on the bottom flange of the control panel received in a slot of the second end plate.

5. The oven appliance of claim 1, wherein the first end plate is mounted to the cabinet without any horizontally-oriented screws, and wherein the second end plate is mounted to the cabinet without any horizontally-oriented screws.

6. The oven appliance of claim 1, wherein the first hook and slot coupling comprises a first pair of hooks on the first end plate received in a first pair of slots in a first brace of the cabinet, and the second hook and slot coupling comprises a second pair of hooks on the second end plate received in a second pair of slots in a second brace of the cabinet.

7. The oven appliance of claim 6, wherein the first pair of hooks are laterally offset from each other.

8. The oven appliance of claim 1, further comprising a first bridge lance on the first end plate and a second bridge lance on the second end plate, the first bridge lance received in a cutout in a first brace of the cabinet, and the second bridge lance received in a cutout in a second brace of the cabinet.

9. The oven appliance of claim 1, wherein the cabinet comprises a left flange along the left side of the cabinet at the top portion of the cabinet and a right flange along the right side of the cabinet at the top portion of the cabinet, a first brace mounted to the cabinet below the left flange, a second brace mounted to the cabinet below the right flange, wherein the first end plate is mounted to the cabinet above the left flange and wherein the second end plate is mounted to the cabinet above the right flange.

10. An appliance, comprising:

a cabinet;

a door mounted to a front portion of the cabinet, the door movable between an open position permitting access to a chamber within the cabinet and a closed position wherein the door encloses the chamber;

a first end plate mounted atop the cabinet by a first hook and slot coupling;

a second end plate mounted atop the cabinet by a second hook and slot coupling;

a first bridge lance on the first end plate the first bridge lance received in a cutout in a first brace of the cabinet; and a second bridge lance on the second end plate, the second bridge lance received in a cutout in a second brace of the cabinet.

11. The appliance of claim 10, further comprising a control panel coupled to the first end plate by a first tab and slot coupling at a left end of the control panel and coupled to the second end plate by a second tab and slot coupling at a right end of the control panel.

12. The appliance of claim 11, wherein the first tab and slot coupling comprises a first pair of sliding retention tabs on the first end plate received in a pair of slots at the left end of the control panel and a second pair of sliding retention tabs on the second end plate received in a pair of slots at the right end of the control panel.

13. The appliance of claim 11, further comprising a first compression tab on a bottom flange of the control panel received in a slot of the first end plate and a second compression tab on the bottom flange of the control panel received in a slot of the second end plate.

14. The appliance of claim 10, wherein the first end plate is mounted to the cabinet without any horizontally-oriented screws, and wherein the second end plate is mounted to the cabinet without any horizontally-oriented screws.

15. The appliance of claim 10, further comprising a back panel of the cabinet, wherein the first end plate is mounted to the cabinet without being fastened to the back panel, and wherein the second end plate is mounted to the cabinet without being fastened to the back panel.

16. The appliance of claim 10, wherein the first hook and slot coupling comprises a first pair of hooks on the first end plate received in a first pair of slots in a first brace of the cabinet, and the second hook and slot coupling comprises a second pair of hooks on the second end plate received in a second pair of slots in a second brace of the cabinet.

17. The appliance of claim 16, wherein the first pair of hooks are laterally offset from each other.

18. The appliance of claim 10, wherein the cabinet comprises a left flange and a right flange, a first brace mounted to the cabinet below the left flange, a second brace mounted to the cabinet below the right flange, wherein the first end plate is mounted to the cabinet above the left flange and wherein the second end plate is mounted to the cabinet above the right flange.

19. An appliance, comprising:

a cabinet;

a door mounted to a front portion of the cabinet, the door movable between an open position permitting access to a chamber within the cabinet and a closed position wherein the door encloses the chamber;

a first end plate mounted atop the cabinet by a first hook and slot coupling;

a second end plate mounted atop the cabinet by a second hook and slot coupling;

a control panel coupled to the first end plate by a first tab and slot coupling at a left end of the control panel and coupled to the second end plate by a second tab and slot coupling at a right end of the control panel;

a first compression tab on a bottom flange of the control panel received in a slot of the first end plate; and a second compression tab on the bottom flange of the control panel received in a slot of the second end plate.

20. The appliance of claim 19, wherein the first hook and slot coupling comprises a first pair of hooks on the first end plate received in a first pair of slots in a first brace of the cabinet, and the second hook and slot coupling comprises a second pair of hooks on the second end plate received in a second pair of slots in a second brace of the cabinet.

* * * * *